US005730241A

United States Patent [19]

Shyr et al.

[11] Patent Number: 5,730,241

[45] Date of Patent: Mar. 24, 1998

[54] CATERPILLAR TRACK SHOE

[75] Inventors: Chorng Rong Shyr, No.14, Lane 9, Ze Chong Road; Ming Chon Cheng, both of Chie An, Furlan, Taiwan

[73] Assignee: Chorng Rong Shyr, Chie An Furlan, Taiwan

[21] Appl. No.: 689,848

[22] Filed: Aug. 15, 1996

[51] Int. Cl.[6] ..... A63C 17/10; A63C 17/12

[52] U.S. Cl. ..... 180/181; 36/139; 280/844

[58] Field of Search ..... 36/137, 139; 200/51 LM, 200/52 R, 86.5; 180/180, 181, 9.1; 280/11.115, 844

[56] References Cited

U.S. PATENT DOCUMENTS 3,876,032 4/1975 Ferino ..... 180/181
4,350,853 9/1982 Ganyard ..... 36/137 X
5,305,846 4/1994 Martin ..... 180/181
5,487,441 1/1996 Endo et al. ..... 280/87.042 X

FOREIGN PATENT DOCUMENTS 343909 11/1921 Germany ..... 180/181

*Primary Examiner*—Brian L. Johnson
*Assistant Examiner*—Michael Mar
*Attorney, Agent, or Firm*—Pro-Techtor International

[57] ABSTRACT

A caterpillar track shoe including a shoe having a plurality of screw holes in the sole; a caterpillar track type driving mechanism fastened to the screw holes of the shoe and controlled to move the shoe on a piece of land through a toe-controlled switch in the shoe and a selector switch on the base frame of the driving mechanism, the driving mechanism including a DC motor, a battery power supply, a caterpillar track assembly, and a gear box coupled between the DC motor and the drive wheel of the caterpillar track assembly.

1 Claim, 2 Drawing Sheets

CATERPILLAR TRACK SHOE

BACKGROUND OF THE INVENTION

The present invention relates to shoes, and relates more specifically to a caterpillar track shoe which is designed for use in carrying and moving the user in the snow or a piece of sandy land.

A variety of shoes and boots, for example ice climbing boots, touring boots, ski boots, ice skates, fencing shoes, boxing shoes, running shoes, hockey skates, football shoes, etc., have been disclosed for different purposes, and have appeared on the market. However, there are no any shoes designed for moving the user on a piece of sandy land.

SUMMARY OF THE INVENTION

The present invention provides a shoe which is practical for moving the user on the snow as well as a piece of sandy land. According to the preferred embodiment of the present invention, the caterpillar track shoe comprises a shoe having a plurality of screw holes in the sole; a caterpillar track type driving mechanism fastened to the screw holes of the shoe and controlled to move the shoe on a piece of land, the caterpillar track type driving mechanism comprising a base frame fastened to the screw holes of the shoe, a battery box mounted within the base frame to hold a rechargeable battery, a motor mounted in the base frame and electrically connected to the rechargeable battery by an electric circuit and controlled by a toe-controlled switch in the shoe and a selector switch on the base frame, a gear box coupled to the motor, a drive wheel assembly transversely mounted on the base frame at one end and turned by the motor through the gear box, an idling wheel assembly transversely mounted on the base frame at an opposite end and turned by the drive wheel assembly through two symmetrical caterpillar tracks, two symmetrical rows of tracker rollers respectively mounted on the base frame at two opposite sides between the drive wheel assembly and the idling wheel assembly, and two caterpillar tracks respectively and bilaterally mounted around the drive wheel assembly, the tracker rollers, and the idling wheel assembly.

DETAILED DESCRIPTION OF THE PREFERRED EMBODIMENT

Figure 1:
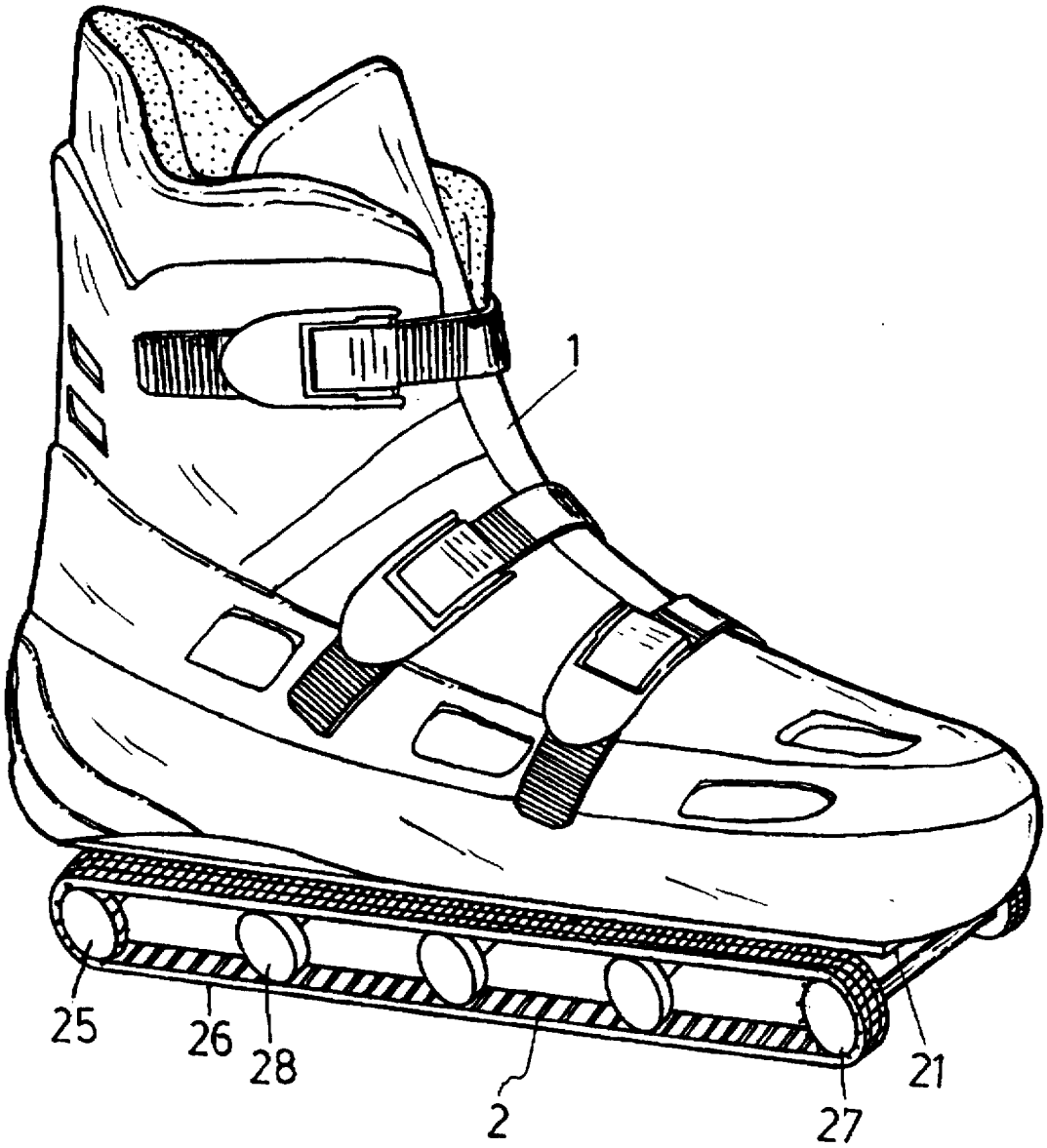
FIG. 1 is an elevational view of a caterpillar track shoe according to the present invention.
Figure 2:
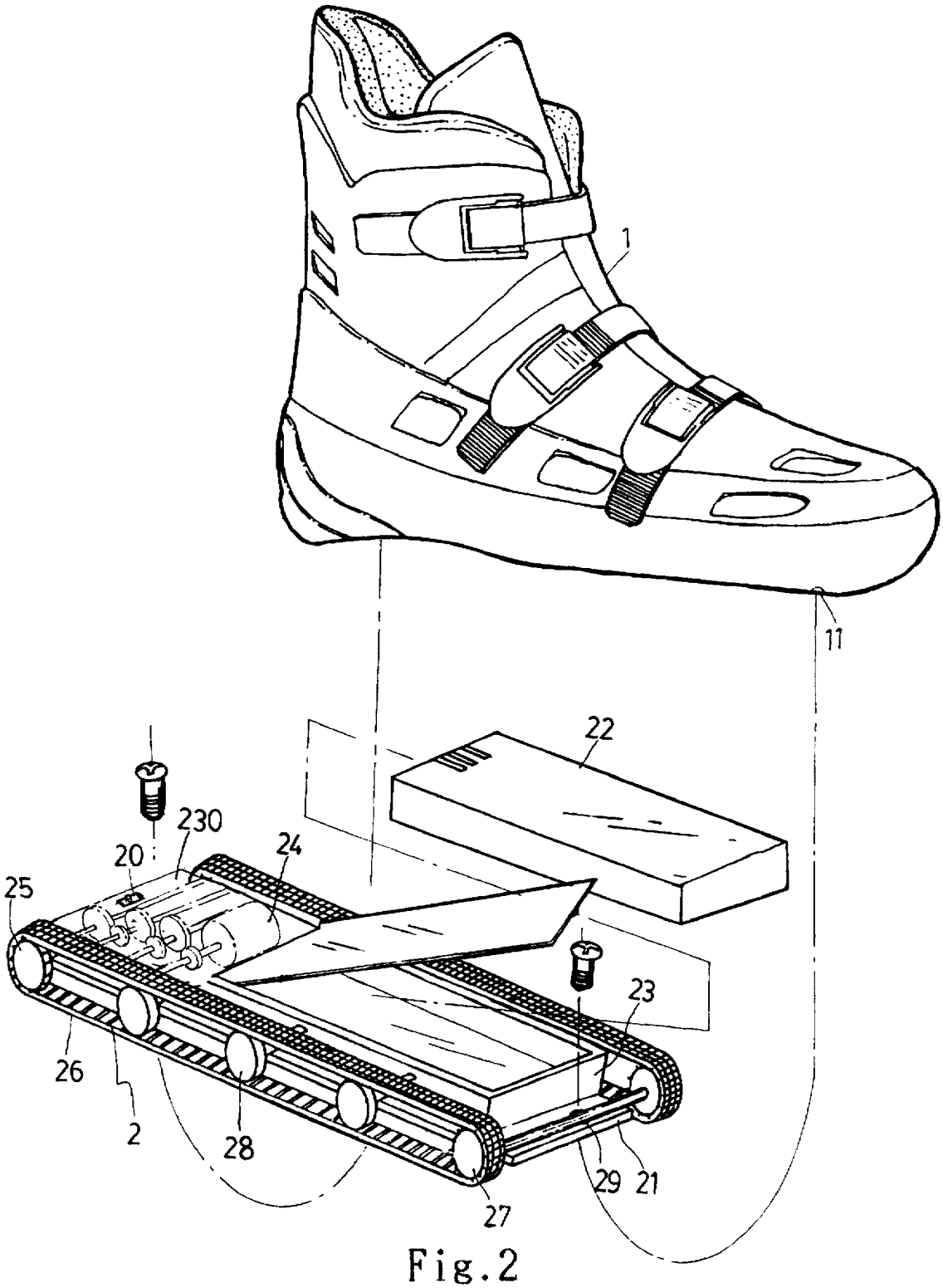
FIG. 2 is an exploded view of the caterpillar track shoe shown in FIG. 1.

Referring to FIGS. 1 and 2, a caterpillar track shoe in accordance with the present invention, is adapted for carrying and moving the user on a snow-covered ground or in a sandy piece of land, comprised of a shoe 1, and a caterpillar track type driving mechanism 2. The shoe 1 has screw holes 11 in the sole to which the caterpillar track type driving mechanism 2 is fastened, and a switch (not shown) adapted for controlling the operation of the caterpillar track type driving mechanism 2 through the big (first) toe. The track type driving mechanism 2 comprises a base frame 21, a battery box 23 mounted within the base frame 21 in the middle to hold a rechargeable battery 22, a motor 24 mounted in the base frame 21 at a suitable location for example at the rear side behind the battery box 23, a gear box 230 coupled to the motor 24, a drive wheel assembly 25 transversely mounted on the base frame 21 at the rear side and turned by the motor 24 through the gear box 230, an idling wheel assembly 27 transversely mounted on the base frame 21 at the front side and turned by the drive wheel assembly 25 through two symmetrical caterpillar tracks, two symmetrical rows of tracker rollers 28 respectively mounted on the base frame 21 at two opposite sides between the drive wheel assembly 25 and the idling wheel assembly 27, and two caterpillar tracks 26 respectively and bilaterally mounted around the drive wheel assembly 25, the tracker rollers 28, and the idling wheel assembly 27. The base frame 21 further has a plurality of mounting holes 29 respectively fastened to the screw holes 11 in the sole of the shoe 1 by respective screws. A selector switch 20 is mounted on the base frame 21 on the outside and connected to the electric circuit of the rechargeable battery 22.

When assembled, the battery power of the rechargeable battery 22 is provided to the motor 24 through the switch in the shoe 1 via the selector switch 20. When the selector switch 20 is shifted to a first position, the motor 24 is constantly turned on; when the selector switch 20 is shifted to a second position, the motor 24 can then be turned on/off through the switch in the shoe 11. When the motor 24 is turned on, the drive wheel assembly 25 is turned to rotate the caterpillar tracks 26, thereby causing the shoe 1 to be moved on a piece of snow-covered or sandy land.

While only one embodiment of the present invention has been shown and described, it will be understood that various modifications and changes could be made without departing from the spirit and scope of the invention disclosed. For example, brake means may be installed, and controlled to stop the shoe from moving.

What the invention claimed is:

1. A caterpillar track shoe comprising:

a shoe having a plurality of screw holes in a sole thereof;

a caterpillar track type driving mechanism fastened to the screw holes of said shoe and controlled to move said shoe across a piece of land, said caterpillar track type driving mechanism comprising a base frame fastened to the screw holes of said shoe, a battery box mounted within the base frame to hold a rechargeable battery, a motor mounted in said base frame and electrically connected to said rechargeable battery by an electric circuit, a gear box coupled to said motor, a drive wheel assembly transversely mounted on said base frame at one end and turned by said motor through said gear box, an idling wheel assembly transversely mounted on said base frame at an opposite end and turned by said drive wheel assembly through two symmetrical caterpillar tracks, two symmetrical rows of tracker rollers respectively mounted, along two opposite sides of said base frame between said drive wheel assembly and said idling wheel assembly, said two caterpillar tracks being mounted around said drive wheel assembly, said tracker rollers, and said idling wheel assembly;

first switch means mounted on an outer surface of the base frame of said caterpillar track type driving mechanism, the first switch being movable between an on position, for maintaining said motor in a constant driving mode, and an off position; and second switch means mounted within said shoe, and adapted to be selectively actuated by a portion of a user's foot received within the shoe for controlling the flow of electric current to said motor when said first switch means is in the off position.

* * * * *